US006695692B1

(12) United States Patent
York

(10) Patent No.: US 6,695,692 B1
(45) Date of Patent: Feb. 24, 2004

(54) CURB MOUNT SKYLIGHT AND SOLAR FAN COMBINATION UNIT

(76) Inventor: Ronald V York, 1824 Dillingham Blvd., Honolulu, HI (US) 96819

( * ) Notice: Subject to any disclaimer, the term of this patent is extended or adjusted under 35 U.S.C. 154(b) by 0 days.

(21) Appl. No.: 10/348,526

(22) Filed: Jan. 20, 2003

(51) Int. Cl.[7] ..... F24F 7/02
(52) U.S. Cl. ..... 454/199; 454/900
(58) Field of Search ..... 454/199, 341, 454/352, 353, 355, 356, 900

(56) References Cited

U.S. PATENT DOCUMENTS

| | | | | | |
|---|---|---|---|---|---|
| 1,749,343 | A | | 3/1930 | Hersh | |
| 3,085,490 | A | * | 4/1963 | Field | 52/200 |
| 3,839,949 | A | * | 10/1974 | Gobel | 454/199 |
| 4,051,769 | A | | 10/1977 | Nickerson et al. | |
| 4,164,106 | A | * | 8/1979 | Klosz | 52/72 |
| 4,432,273 | A | | 2/1984 | Devitt | |
| 4,558,634 | A | | 12/1985 | Oshiro et al. | |
| 4,680,815 | A | | 7/1987 | Hirsh et al. | |
| 4,899,645 | A | | 2/1990 | Wolfe et al. | |
| 5,078,047 | A | * | 1/1992 | Wimberly | 454/368 |
| 5,131,888 | A | * | 7/1992 | Adkins, II | 454/343 |
| 5,154,481 | A | | 10/1992 | Paetz et al. | |
| 5,344,361 | A | * | 9/1994 | Matthias | 454/129 |
| 5,353,601 | A | | 10/1994 | Palmer | |
| 5,433,660 | A | | 7/1995 | Ohba | |
| 5,488,801 | A | | 2/1996 | Nix | |
| 6,142,645 | A | * | 11/2000 | Han | 362/147 |

* cited by examiner

*Primary Examiner*—Harold Joyce
(74) *Attorney, Agent, or Firm*—Michael I Kroll

(57) ABSTRACT

The present invention 10 discloses a fan/skylight combination unit mounted on a common frame 19 wherein the preferred embodiment includes a fan assembly 14 powered by photovoltaic panels 16 thereby providing increased natural lighting into the interior of the structure 12 while removing excessive heat therefrom. The white outer dome 38 reflects heat therefrom and the air space between the inner 40 and outer 38 domes serves as a thermal barrier to prevent the transfer of heat from the atmosphere into the, interior of the structure 12. The solar rays collected by the photovoltaic panel 16 energize the fan motor 20 and forcibly ventilates the interior of the structure 12.

15 Claims, 6 Drawing Sheets

CURB MOUNT SKYLIGHT AND SOLAR FAN COMBINATION UNIT

BACKGROUND OF THE INVENTION

1. Field of the Invention

The present invention relates generally to skylights and, more specifically, to a modular skylight and solar fan combination unit that will allow the installer to install both a skylight and a solar fan into a single rough opening. The present invention cost effectively increases the comfort and health of persons inside of structures in which it is installed.

It is critical to provide a means for accumulated heat to be removed from the uppermost portions of a house or building to prevent heat build-up and to assure adequate air quality therein. Poor air quality not only compromises the comfort level therein but poses significant health risks to the inhabitants thereof due to mold and other such conditions. Static vents are frequently used but are limited in their effectiveness particularly during the summer months or in warmer climates. Electric fans are also used for venting and have been found to efficiently remove a substantial amount of air to reduce the interior ambient temperature but are costly as they rely on the external power supplied to the building structure and also require running electric wires thereto which is labor intensive and could add significantly to the installation cost thereof when being installed in an existing finished structure. Lowering the interior ambient temperature greatly reduces the reliance on air conditioning systems but the cumulative power demands of a properly ventilated community using electric fans still places an unnecessary burden on the local utility which could be critical in times of extreme heat when communities often face brownout or even blackout conditions.

Skylights are frequently used to introduce natural ambient light into dwellings and serve to further reduce the reliance on power provided by public utilities but frequently increase the temperature therein by acting essentially as a magnifying glass. The present invention addresses this concern by utilizing a dual-domed skylight wherein the outer dome is comprised of a white translucent acrylic for reflecting the heat from the sun and diffusing and softening the light entering therethrough whereas the inner dome is a transparent acrylic and operates conjunctively with the outer dome to form a thermal barrier that minimizes the heat exchange from the atmosphere into the interior of the room.

2. Description of the Prior Art

There are other solar powered devices. Typical of these is U.S. Pat. No. 1,749,343 issued to E. F. Hersh on Mar. 4, 1930.

Another patent was issued to M. H. Nickerson et al. on Oct. 4, 1977 as U.S. Pat. No. 4,051,769. Yet another U.S. Pat. No. 4,432,273 was issued to G. J. Devitt on Feb. 21, 1984 and still yet another was issued on Dec. 17, 1985 to T. Oshiro et al. as U.S. Pat. No. 4,558,634.

Another patent was issued to G. B. Hirsch on Jul. 21, 1987 as U.S. Pat. No. 4,680,815. Yet another U.S. Pat. No. 4,899,645 was issued to P. R. Wolfe et al. on Feb. 13, 1990 and still yet another was issued to W. Paetz et al. on Oct. 13, 1992 as U.S. Pat. No. 5,154,481.

Another patent was issued to G. R. Palmer on Oct. 11, 1994 as U.S. Pat. No. 5,353,601. U.S. Pat. No. 5,433,660 was issued on Jul. 18, 1995 to S. Ohba and on Feb. 6, 1996 M. E. Nix was issued U.S. Pat. No. 5,488,801.

U.S. Pat. No. 1,749,343

Inventor: Earl F. Hersh

Issued: Mar. 4, 1930

A cooling structure having an insulated floor, an outer wall, an outer roof, an inner wall extending upward from the floor and spaced from the outer wall, an inner roof associated with the inner wall to thus provide an air circulating space between the outer an inner walls and the outer and inner roofs, a chamber into which said space opens having louvers, ventilators disposed in the floor and ventilating pipes extending up from the inner roof and extending exteriorly to the outer roof and having a damper.

U.S. Pat. No. 4,051,769

Inventor: Malcolm H. Nickerson et al.

Issued: Oct. 4, 1977

Apparatus and method for venting moisture from the interior of an enclosed space to atmosphere while restricting the flow of ambient moisture back into the enclosed space. A chamber is provided in fluid communication with the substantially enclosed space. Means are provided for absorbing solar energy for heating the interior of the chamber when the chamber is exposed to sunlight. A first pressure sensitive valve is effective to vent moisture, liquid or other fluids from the chamber to atmosphere and to block flow between the chamber and the substantially enclosed space during the periods when the chamber is exposed to sunlight. A second pressure sensitive valve blocks flow of ambient air into the chamber and vents moisture or other gaseous material from the substantially enclosed space to the chamber during periods when the chamber is not exposed to sunlight. The method, according to the present invention, comprises the steps of venting moisture from an enclosed space into a chamber during periods where the chamber is not exposed to sunlight, sealing against backflow of gaseous material from the chamber to the enclosed space and venting the chamber to the atmosphere during periods of heating of the chamber by the sunlight to thereby vent fluid material from the enclosed space to the atmosphere.

U.S. Pat. No. 4,432,273

Inventor: Gerald J. Devitt

Issued: Feb. 21, 1984

A roof vent for flat built-up roofs, having a truncated pyramid-shaped air stack with a protective cap and an internal fan for inducing upward air flow through a check valve at the upper end of the stack. A solar panel provides power for operating the fan, a thermal switch is employed for enabling the fan above an ambient temperature of 50 degrees F. (10 degrees C.) and a humidistat may be employed for disabling the fan below 50% relative humidity.

U.S. Pat. No. 4,558,634

Inventor: Takao Oshiro et al.

Issued: Dec. 17, 1985

A ventilation system for a motor vehicle such as an automobile includes a ventilating hole defined in a body of the motor vehicle for venting an interior of the body to atmosphere, and an aerodynamic device such as an air spoiler mounted on the body at the ventilating hole and having a lower surface held against an outer surface of the body, a front surface for forming a negative angle of elevation with respect to an air current flowing along the body while the automobile is running, and a rear surface for separating the air current off said body. The aerodynamic device has a vent hole extending therethrough from the lower surface to the rear surface in communication with the ventilating hole.

U.S. Pat. No. 4.680,815

Inventor: Gerald B. Hirsch et al.

Issued: Jul. 21, 1987

The present invention includes a self-contained personal cooling device. It is a one-piece modular component which is pre-wired and interchangeable between different hats. The components of the modular unit are employed in the unit to effect total body cooling by evaporation and forced convection. The unit is powered by photo-voltaic energy. The cooling effect of this modular device is maximized by incorporating air vent slots adjacent to the fan motor assembly to increase the force of air delivery.

U.S. Pat. No. 4,899,645

Inventor: Philip R. Wolfe et al.

Issued: Feb. 13, 1990

A solar ventilator (1) is fittable to an edge (2) having first and second sides corresponding to first and second regions. The edge can be of a barrier, e.g. of a movable window of a motor vehicle or of a building. The ventilator has a suspension (5) for suspending the ventilator from the edge so that the ventilator will be adjacent the first region. The ventilator has a housing (4) having inlet and outlet portions (11, 12) for enabling air to be transferred therebetween from a region to the other region. A fan (13) is comprised by the housing so as to enable the transfer of air. A solar generator (15) drives the fan. The ventilator may be arranged for direct or indirect reception of solar radiation.

U.S. Pat. No. 5,154,481

Inventor: Werner Paetz et al.

Issued: Oct. 13, 1992

Vehicle roof with at least one cover that, alternatively, closes or at least partially opens an opening in a fixed roof surface of the vehicle, carries a solar power source for supplying power to at least one power consuming device that is separately located from the cover, and with a contact device for producing an electrical connection between the solar power source and the consuming device. The contact device is made as a switch arrangement that incorporates the cover so that the power consuming device is connected to the solar power source in one or more predetermined cover positions and is disconnected from the solar power source in all other cover positions.

U.S. Pat. No. 5,353,601

Inventor: Gerald R. Palmer

Issued: Oct. 11, 1994

A structural cooling system is disclosed, which includes an evaporative cooler suitable for cooling a body of air in an upper, enclosed chamber of a structure, such as an attic, and a series of vents or ducts, particularly around the perimeter of the building, for applying the cooled air selectively to high heat-gain portions of the exterior of the structure. An interior cooling system, which may include an air-conditioning unit, is suitable for cooling the interior of the building, but will require only reduced capacity, because of the cooling effect on the structure's exterior.

U.S. Pat. No. 5,433,660

Inventor: Shunji Ohba

Issued: Jul. 18, 1995

An automatic vehicular ventilating system ventilates the passenger room of a vehicle such as automobiles, aircraft, railway passenger cars and ships to maintain air in the passenger room at a fixed temperature automatically. The automatic vehicular ventilating system includes a solar power supply unit having a solar panel as a power supply, a first switch responsive to the output of a thermostat, and a second switch in communication with at least at least one of an ignition switch of the vehicle and a hand brake of the vehicle; an exhaust unit having an air exhaust damper; and a fresh air supply unit having an air supply damper. The air exhaust damper and the air supply damper are driven by electric power supplied from the solar power supply unit.

U.S. Pat. No. 5.488,801

Inventor: Martin E. Nix

Issued: Feb. 6, 1996

Designed is a system for recycling abandoned appliances as refrigerators, for conversion into solar applications. Designed is a converted refrigerator into a solar greenhouse, thus extending the growing season in cold climates. Illustrated is a solar powered fan, a skylight with a back reflector, a door window, screen to provide an insect barrier and a recycled refrigerator.

While these solar powered devices may be suitable for the purposes for which they were designed, they would not be as suitable for the purposes of the present invention, as hereinafter described.

SUMMARY OF THE PRESENT INVENTION

The present invention discloses a fan/skylight combination unit mounted on a common frame wherein the preferred embodiment includes a fan assembly powered by photovoltaic panels thereby providing increased natural lighting into the interior of the structure while removing excessive heat therefrom. The white outer dome reflects heat therefrom and the air space between the inner and outer domes serves as a thermal barrier to prevent the transfer of heat from the atmosphere into the interior of the structure. The solar rays collected by the photovoltaic panel energize the fan motor and forcibly ventilates the interior of the structure.

A primary object of the present invention is to provide a curb mount solar fan and skylight combination unit that will conserve energy by using natural resources to ventilate and illuminate a home or commercial building.

Another object of the present invention is to provide a curb mount solar fan and skylight combination unit that is installed in a single rough opening thereby reducing the time and cost of installation.

Still another object of the present invention is to provide a curb mount solar fan and skylight combination unit that doesn't require the running of electric lines thereto thereby reducing the time and cost of installation.

Yet another object of the present invention is to provide a curb mount solar fan and skylight combination unit that is environmentally friendly.

Still another object of the present invention is to provide a curb mount solar fan and skylight combination unit that will lower the interior ambient temperature within a building in which it is installed.

One other object of the present invention is to provide a curb mount solar fan and skylight combination unit that will introduce natural overhead lighting from the atmosphere into the room in which it is installed without increasing the ambient temperature therein.

Still yet another object of the present invention is to provide a curb mount solar fan and skylight combination unit wherein the skylight is double-domed with an air pocket therebetween to act as a thermal barrier and the top dome being translucent with a reflective finish to reduce heat transfer therethrough and the lower dome being transparent.

Yet another object of the present invention is to provide a solar fan and skylight combination unit that will improve the overall air quality and reduce or eliminate interior mold.

Another object of the present invention is to provide a solar fan and skylight combination that is aesthetically pleasing and minimizes disruption of the roofline.

One other object of the present invention is to provide a curb mount solar fan and skylight combination unit wherein the mounting frame is configured to allow for the removal of the solar fans for replacement, maintenance or repair without disturbing the roof Another object of the present invention is to provide a curb mount solar fan and skylight combination unit that is simple and easy to use.

Yet another object of the present invention is to provide a curb mount solar fan and skylight combination unit that is inexpensive to manufacture to and operate.

Additional objects of the present invention will appear as the description proceeds.

The present invention overcomes the shortcomings of the prior art by providing an easy to install curb mount solar fan and skylight combination unit that provides forced ventilation and natural lighting without any outside power demands and provides for the quick and simple removal of the solar fans as warranted.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
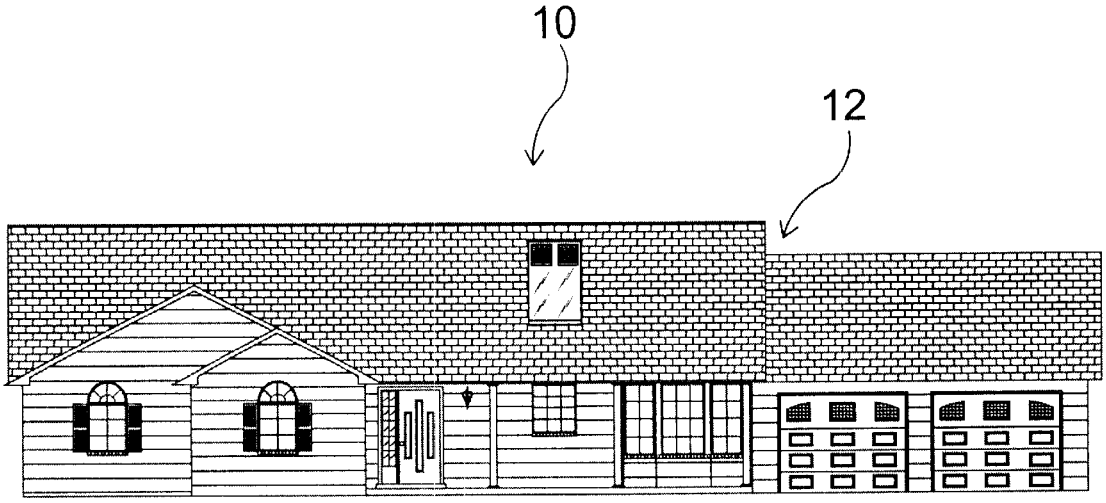
FIG. 1 is an illustrative view of the present invention in use.

With regards to reference numerals used, the following numbering is used throughout the drawings.

10 present invention
12 house
14 solar fan assembly
16 photovoltaic panel
18 photovoltaic panel housing
19 base frame
20 fan motor
22 fan blade
24 fan motor housing
26 fan mounting bracket
27 vertical clips
28 cylindrical portion of fan housing
30 square portion of fan housing base
32 cylindrical screen
34 flat screen
36 retaining element
38 white outer dome
40 clear acrylic inner dome
42 sun
44 radiant heat arrows
46 sun light beam
48 heat arrows reflected by outer dome
50 flange
52 upper portion of base frame
54 lower portion of base frame
56 structural member
58 recess

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 installed in the roof of a building 12, for example, a house. The present invention 10 is a modular passive lighting and forced ventilation unit comprising a skylight vented with solar fans that can be installed in a single rough opening without the need for running any electric lines thereto. The present invention 10 relies on natural resources to provide lighting into and ventilation from the interior portion of the structure 12 it is installed upon thereby increasing the comfort level and health of the occupants therein while reducing electric bills incurred by unnecessary use of electric lighting and excessive air conditioning and in many instances eliminating the need for air conditioning altogether. The present invention 10 improves the overall air quality and reduces or eliminates interior mold.

Figure 2:
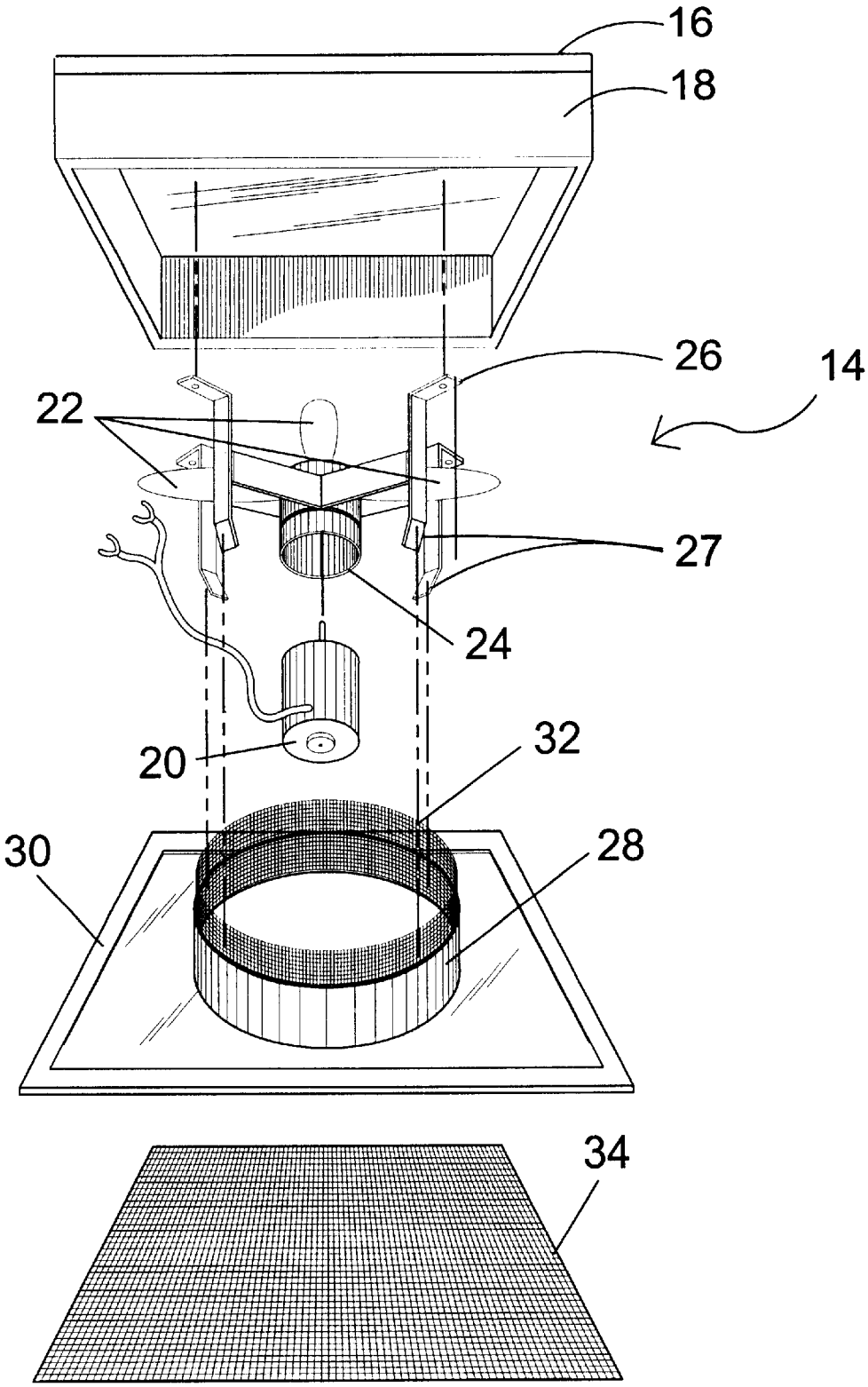
FIG. 2 is an exploded view of the solar fan assembly.

Turning to FIG. 2, shown therein is an exploded view of the solar fan assembly 14 of the present invention. The solar fan assembly 14 comprises at least one photovoltaic panel 16 bonded to the top side of a one-piece abs plastic housing 18 that covers the fan motor 20, fan blade 22, fan motor housing 22 and related mounting brackets 26. The vertical clips 27 of the fan mounting bracket 26 assembly provide the means for frictionally attaching the photovoltaic panel housing member 18 to the cylindrical portion 28 of the housing base member. The fan housing 18 is UV stabilized using Korad protection. Also shown are the square fan housing base 30, the cylindrical stainless steel (S.S.) screen 32 and flat stainless steel screen 34.

Figure 3:
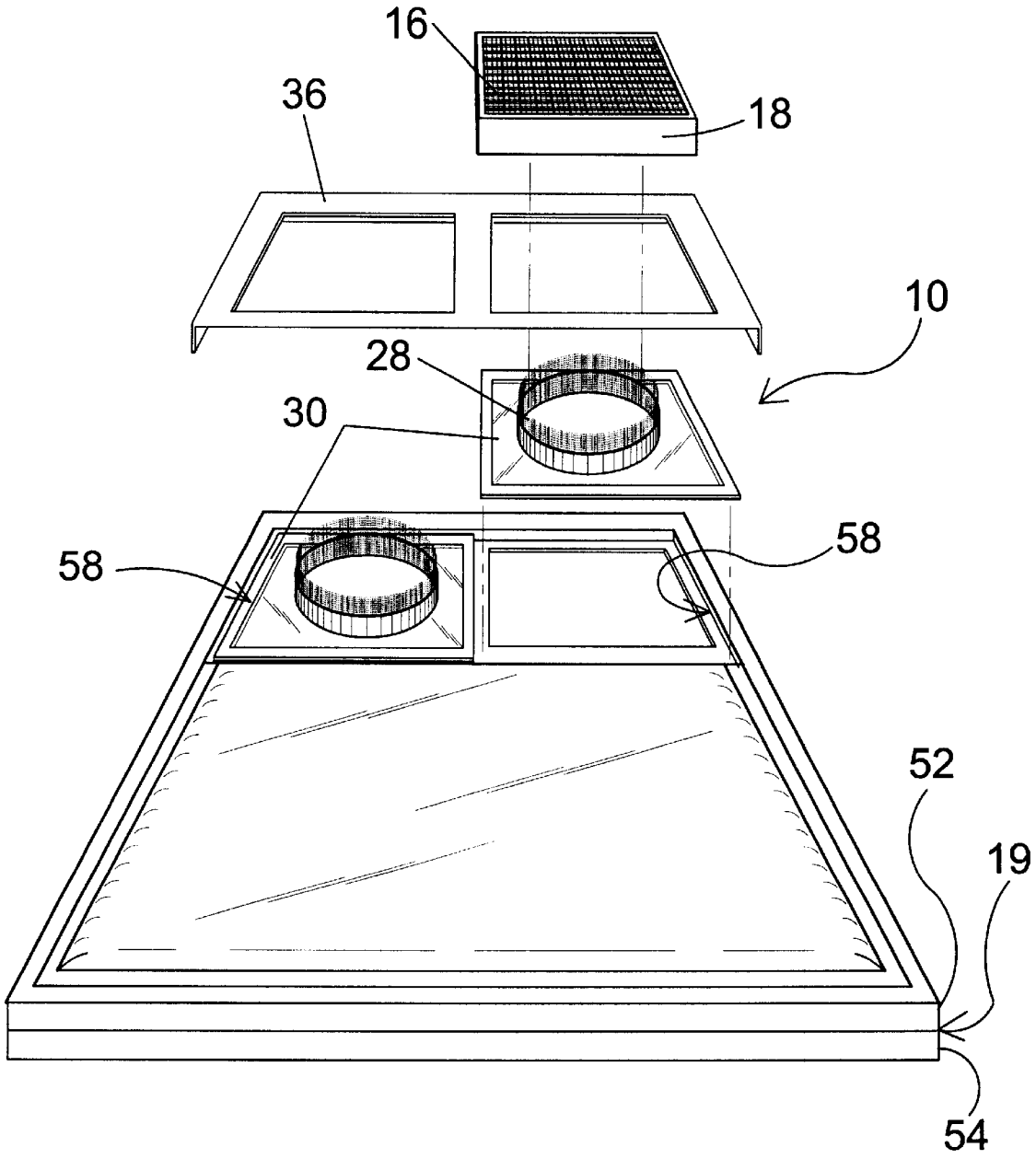
FIG. 3 is an exploded view of the present invention.

Turning to FIG. 3, shown therein is an exploded perspective view of the present invention 10. One square fan housing base member 30 for a solar fan is seated in a complimentarily shaped receiving recess 58 within the periphery of the opening of base frame member 19 and the other is ready for placement in a second recess 58 of the opening adjacent thereto. Base frame 19 has an upper 52 and lower 54 portion which can be best seen in FIG. 4. The retaining element 36 is then secured to the frame member 19 and acts as a vice-like clamp for securing the bases 30 of each solar fan assembly 14 (not shown, but see FIG. 2) thereto. The solar panel housing members 18 are then frictionally secured to the cylindrical portion 28 of the base members as previously explained. The fan and photovoltaic panel members are spaced apart by circumferential stainless steel screen 32 forming an exhaust egress or intake ingress for air movement. Even when the fan is shut off, hot air will be vented and insects will be blocked from entry. Also shown is the photovoltaic panel 16 mounted on top of housing 18.

Figure 4:
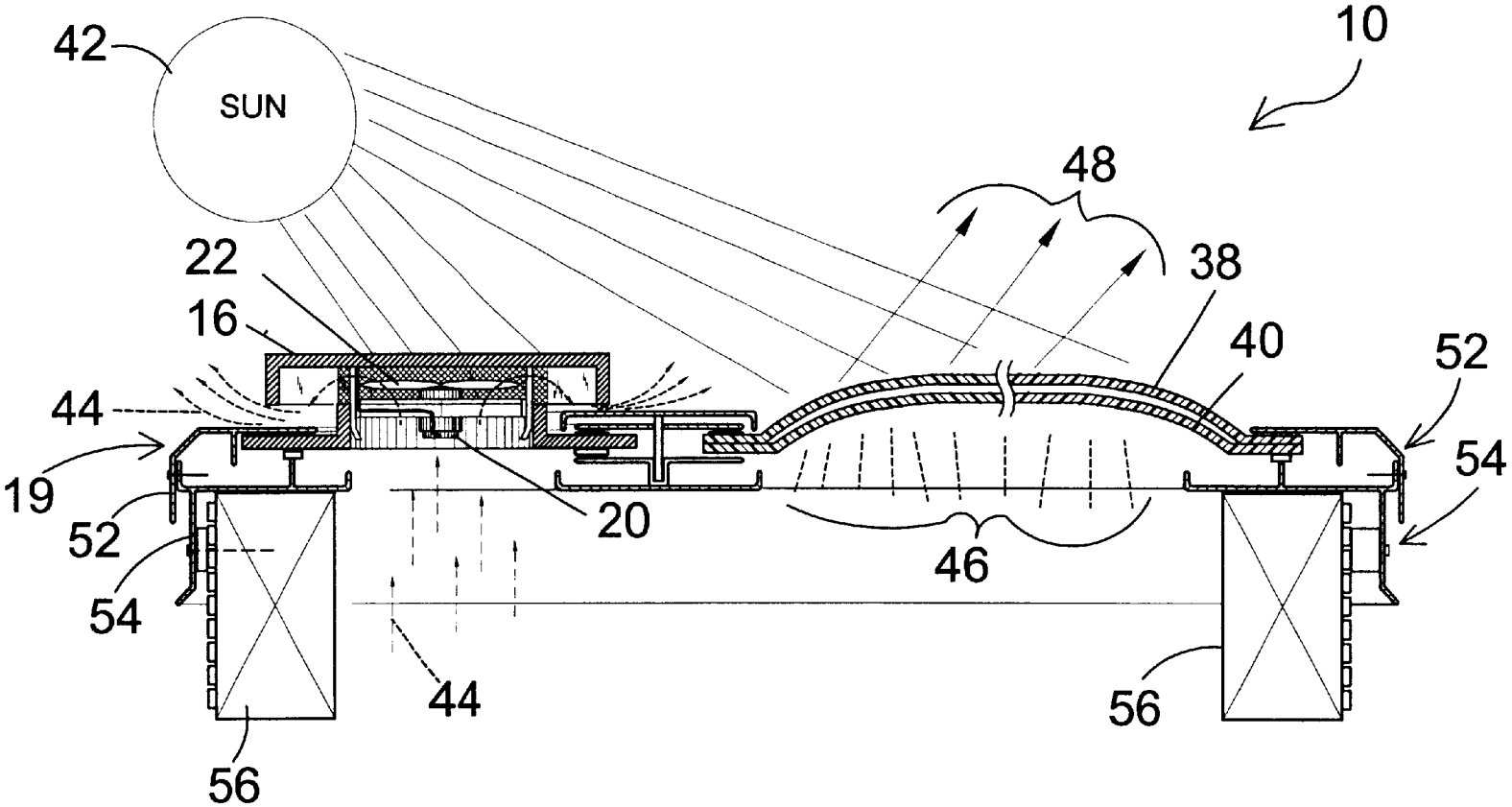
FIG. 4 is a sectional side view of the present invention.

Turning to FIG. 4, shown therein is a sectional side view of the present invention 10. The present invention 10 is a fan/skylight combination unit mounted on a common frame 19 wherein the preferred embodiment includes a fan motor 20 and fan blades 22 powered by photovoltaic panels 16 thereby providing increased natural lighting into the interior of the structure while removing excessive heat therefrom. Base frame 19 has an upper 52 and lower 54 portion and is mounted on an appropriate structural member 56 of the building as would be done in the conventional manner by one skilled in the art. The white outer dome 38 reflects heat therefrom and the gap between the clear acrylic inner dome 40 and outer domes 38 serves as a thermal barrier to prevent the transfer of heat from the atmosphere into the interior of the room. The solar rays collected by the photovoltaic panel 16 energize the fan motor 20 and forcibly ventilates the interior of the structure. Also shown are the sun 42, radiant heat arrows 44 exiting the interior of the structure, sun light beams 46 entering the structure and the heat arrows 48 reflected from the white outer dome 38.

Figure 5:
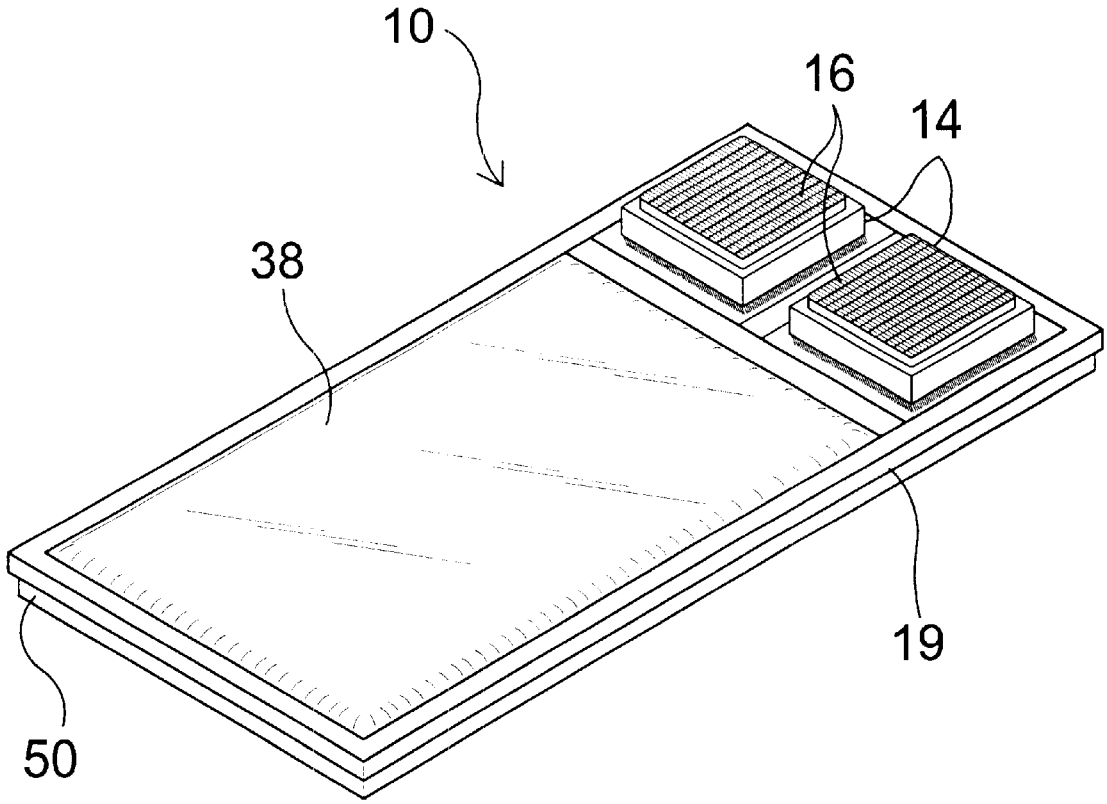
FIG. 5 is a perspective view of the present invention.

Turning to FIG. 5, shown therein is a perspective view of the present invention 10. Photovoltaic panels 16 harvest the potential energy of the sun and convert it to electrical power for operating the solar fan assembly 14 thereby enabling the present invention to remove radiant heat from the interior of the building it is installed upon. Dual acrylic domes form a thermal barrier in the skylight thus creating an insulated air space to effectively reduce the amount of heat gain due to the sunward facing skylight. Furthermore, the outer dome 38 is fabricated of a white acrylic and the inner dome is clear acrylic thus allowing the reflective properties thereof to minimize heat gain while permitting light to pass therethrough. The aluminum base frame 19 is coated with a bronze powder finish and has an upper flange 50 thereon for mounting in the conventional manner.

Figure 6:
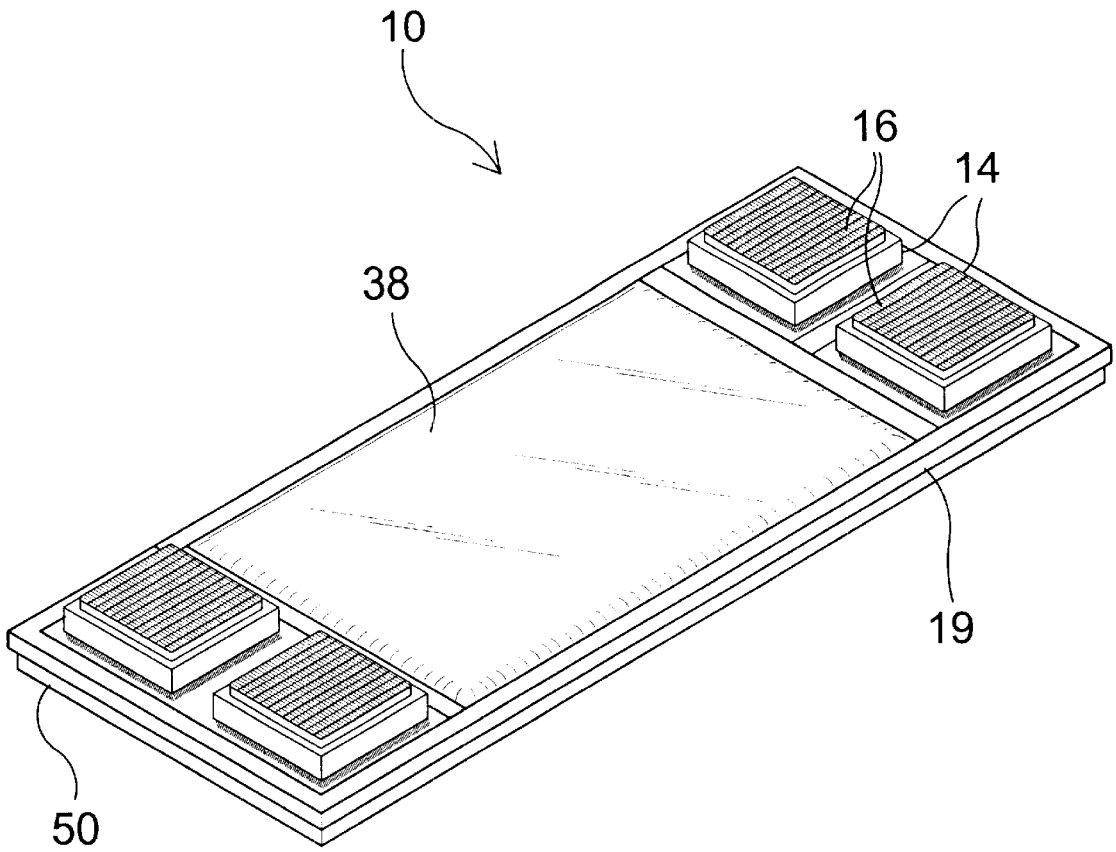
FIG. 6 is a perspective view of the present invention.

Turning to FIG. 6, shown therein is a perspective view of the present invention 10. The present invention 10 may utilize any number of configurations to accommodate a plurality, e.g., four units as shown here, of solar fan assemblies 14 thereby providing high volume ventilation and natural lighting in a single unit which requires no external wiring or power. The present invention 10 overcomes the shortcomings of the prior art by providing a passive lighting and a forced ventilation system in a single self-contained unit that is simple to install and virtually cost free to operate. Also shown are the photovoltaic panels 16, acrylic dome 38, and aluminum base frame 19 with flange 50.

What is claimed to be new and desired to be protected by Letters Patent is set forth in the appended claims:

I claim:

1. An apparatus for a combination skylight and solar powered exhaust fan for mounting to a structural member on the roof of a building, comprising:

a) a base frame for mounting onto a structural member of a building, said base frame having at least one opening therein, said opening having a recess disposed about its periphery for receiving a fan housing base of a solar fan assembly, said base frame having an upper portion and a lower portion;

b) a fan housing base disposed in said recess of said base frame, said fan housing base having a centrally disposed aperture therein, said centrally disposed aperture for receiving a solar fan assembly therein;

c) a cylindrical fan housing centrally disposed on said fan housing base, said cylindrical fan housing forming a fan housing around said centrally disposed aperture for receiving a solar fan assembly, said cylindrical fan housing having an inner and outer surface;

d) a retaining element for securing said fan housing base to said base frame, said retaining element having at least one opening therein for receiving said solar fan assembly and a photovoltaic panel, wherein said fan housing base is secured between said retaining element and said base frame;

e) means for a solar fan assembly whereby said fan assembly is powered by a photovoltaic panel, wherein said means for solar fan assembly is connected to said cylindrical fan housing; and f) a pair of skylight domes disposed between said upper and lower portions of said base frame adjacent to said fan housing base and said retaining element to permit sunlight to pass into the interior of the building, wherein said pair of domes are concentrically mounted to form an inner dome and an outer dome having a cavity therein between so that the cavity forms an insulating barrier between the inner and outer domes.

2. The apparatus of claim 1, wherein said means for a solar fan assembly, comprises:

a) a fan motor for rotating a fan blade;

b) a fan blade disposed on said fan motor;

c) a fan motor housing disposed about said fan motor;

d) a fan mounting bracket disposed about said fan motor to permit attachment to a photovoltaic panel housing and the inner surface of the cylindrical fan housing;

e) a photovoltaic panel housing, said photovoltaic panel housing being complimentarily sized and shaped to be disposed on and above said cylindrical fan housing, said photovoltaic panel having a top side; and, f) a photovoltaic panel disposed on said top of said photovoltaic panel housing to collect energy from the sun.

3. The apparatus of claim 2, further comprising a screen disposed around the periphery of said cylindrical fan housing to prevent insects from passing therethrough.

4. The apparatus of claim 3, wherein said screen comprises stainless steel.

5. The apparatus of claim 3, further comprising a screen disposed over said housing base to prevent insects from passing therethrough.

6. The apparatus of claim 5, wherein said screen comprises stainless steel.

7. The apparatus of claim 6, wherein there are a pair of solar fan assemblies disposed in the base frame.

8. The apparatus of claim 7, wherein there are four solar fan assemblies disposed in the base frame.

9. The apparatus of claim 8, wherein said outer dome is white to reflect heat.

10. The apparatus of claim 9, wherein said inner dome is clear to allow light to pass therethrough.

11. The apparatus of claim 10, wherein said photovoltaic panel housing comprises plastic.

12. The apparatus of claim 11, wherein said photovoltaic panel housing is ultraviolet stabilized to permit a longer life.

13. The apparatus of claim 12, wherein said base frame further comprises a flange disposed about said upper portion to aid in mounting onto a structural member of a building.

14. The apparatus of claim 13, wherein said base frame comprises aluminum.

15. The apparatus of claim 14, wherein said inner dome comprises acrylic.

* * * * *